US006208806B1

(12) United States Patent
Langford

(10) Patent No.: US 6,208,806 B1
(45) Date of Patent: Mar. 27, 2001

(54) ELECTRIC WATER HEATER CONTROL

(75) Inventor: Newton Langford, North Balwyn (AU)

(73) Assignee: Aquabeat Pty Ltd., Victoria (AU)

( * ) Notice: Subject to any disclaimer, the term of this patent is extended or adjusted under 35 U.S.C. 154(b) by 0 days.

(21) Appl. No.: 09/338,930

(22) Filed: Jun. 23, 1999

(30) Foreign Application Priority Data

Jun. 24, 1998 (AU) ..... PP4279

(51) Int. Cl.[7] ..... H05B 1/02
(52) U.S. Cl. ..... 392/464; 392/449; 392/498
(58) Field of Search ..... 392/464; 364/492, 364/493

(56) References Cited

U.S. PATENT DOCUMENTS 4,075,699 * 2/1978 Schneider et al. ..... 364/492
4,167,786 * 9/1979 Miller et al. ..... 364/493
4,283,772 * 8/1981 Johnston ..... 364/900
4,390,876 * 6/1983 Bjorklund et al. ..... 340/825.17
4,442,492 * 4/1984 Karlsson et al. ..... 705/412
4,819,180 * 4/1989 Hedman et al. ..... 364/492
5,168,170 * 12/1992 Hartig ..... 307/35
5,339,445 * 8/1994 Gasztonyi ..... 395/750.06

* cited by examiner

*Primary Examiner*—Teresa Walberg
*Assistant Examiner*—Thor Campbell
(74) *Attorney, Agent, or Firm*—Connolly Bove Dodge & Hutz

(57) ABSTRACT

A domestic water heater 10 includes a water meter 14 to count the units of water used each day and has a timer 17 to time the heating cycle each day. A programmable means 18 stores the water usage and heating data for a sixty day period and using statistical techniques determines the time period required for heating the water in the tank 10. The means 18 also stores power load curve data from the power generator and matches the required heating time to an appropriate portion of a low in the power load curve. The tanks may be placed in any one of 9 groups and a tank in each group will by virtue of the program in means 18 center the mid point of the calculated heating period on the same time during the off peak period. Tanks fitted with such controllers can be allocated into one of two or more categories to enable a power utility to reallocate the water heater power load into low cost periods of the power load curve.

6 Claims, 3 Drawing Sheets

ELECTRIC WATER HEATER CONTROL

CROSS REFERENCE TO RELATED APPLICATION

This application relates to U.S. patent application Ser. No. 08/936,816, filed Sep. 24, 1997, now allowed.

This invention relates to control of domestic electric water heaters.

Electric heating appliances are major consumers of electric power and power utilities have attempted to address the problem of controlling peak demand by encouraging off peak heating of such appliances with reduced tariffs. However this often leads to the inconvenience of hot water or heating not being available when it is needed. A consequence has been that consumers switch from using electric power to a more demand responsive energy source such as gas for hot water and space heating.

One means of dealing with this problem has been for the power utilities to develop a more demand responsive distribution system. This usually entails using high frequency signals sent over the power lines to activate or deactivate heaters at individual sites. Examples of this approach are disclosed in Canadian patent 1203568, U.S. Pat. No. 4,888,495 and WO95/22190. U.S. Pat. No. 4,540,875 addresses the control of space heating demand by sensing ambient temperature at a central control point and high frequency signals are superimposed on the normal power line voltage to provide operating instructions to the individual space heaters. Difficulty has been encountered in sending high frequency signals over power lines because of noise interference. U.S. Pat. No. 4,264,960 addressed this problem by using telephone lines to send signals to power substations which then send signals over power lines to remote appliances. U.S. Pat. No. 5,732,193 discloses a behavioristic method of monitoring power usage to accumulate an historical record of power use and then use this data to achieve load leveling for the power utility. These attempts have all aimed at better control of demand from the power utility's perspective by control from the power utility.

The other approach has been to address control from the consumer's perspective by providing control of power consumption at the heater depending on its energy need. These attempts all try to utilize the cheaper off-peak power without compromising the need for instant heating or hot water. U.S. Pat. No. 4,568,821 provides a display and control panel located inside the home and senses the temperature of the water in the hot water tank to enable the consumer to choose the most economical means of obtaining the needed hot water. Most attempts of this kind have tried to automate the switching decisions. U.S. Pat. No. 4,948,948 discloses a water tank with heating elements of different power ratings disposed at different heights in the tank and a timer switches on the elements individually at the most economical time for each element depending on the power utilities tariff.

Another approach based on timer control at the tank is to sense the tank temperature and switch on the heating elements to reheat the tank to a predetermined temperature. Australian specification 33728/84 discloses a tank with several thermostats and several heating elements of different power ratings. Depending on the temperature gradient of the tank as sensed by the thermostats an appropriate element is chosen so that the tank can reach the specified temperature during the allocated off peak period. Thus a tank with only a small heating demand will use the low power element and the higher power rated element will be switched on if the heat demand is high. French patent 2552210 utilizes a timer, a thermostat and an element in a water heater and is arranged so that if the water temperature is above a certain value the heating element is not switched on. U.S. Pat. No. 4,998,024 utilizes a programmable controller for water heaters which is programmed with data relating to optimum periods for heating based on historical data for the seasons and weekdays, weekends and holidays. These systems are still dependent on operating within a preset time period and do little to alleviate the problem of all electric, water or space heaters being switched on at the same time. French patent 2465389 discloses a storage heater control which senses the temperature and the temperature setting of the heater. An electric circuit responsive to this data is connected to the power line and acts to delay the switching on of the heater in response to signal received over the power line.

It is an object of this invention to provide a water or space heater with a controller which improves the economy and/or convenience of these heaters for the consumer and at the same time allow the power utilities to smooth out the demand curve.

BRIEF DESCRIPTION OF THE INVENTION

To this end the present invention provides an electric water heater which includes a) a water tank b) an electric heating element disposed within said tank c) a cold water inlet into said tank d) a hot water outlet from said tank e) optionally at least one thermostat in said tank or a water meter connected to said inlet or outlet to measure the amount of water used f) a calendar/clock and timer connected to said element g) a memory store connected to said water meter and said timer clock to record daily readings of i) optionally, the average temperature of the tank or the amount of water used in the period from one heating period to the next ii) the power used or the time required to heat the water in the tank to the desired temperature and store the readings for a predetermined number of preceding days h) a programmable means programmed to analyze the readings in the memory store and calculate for each day the time duration required to bring the water to the desired temperature i) said memory store including power load curve data collected from the power generator appropriate to the day of week and season and j) said programmable means being programmed to match the required heating duration to a low cost portion of the load curve.

The prior art water tanks did not attempt to calculate the duration of time required to bring the water in the tank to the desired temperature. Further the prior art tank controllers did not store historical data to enable such a calculation to be made. It is possible to obtain an approximate estimate of the time of heating from a number of different data readings. Any one of power used, time of heating, lowest temperature of tank, amount of water used or entering tank, can be used as the basis of a calculation in combination with the known volume of the tank and the rating of the heating element(s). The accuracy of such a calculation can be improved using statistical analysis of stored historical data.

In contrast to the prior art which monitored electric power usage only, or used thermostats to monitor water temperature and power requirements, this invention preferably monitors water usage and heating duration for an individual water heater to establish an historical daily behavior pattern for the tank. By monitoring water usage and statistically analyzing this over a set preceding period and combining this with a similar analysis of heating durations, an accurate assessment of the required heating duration for each day can be calculated. By combining heating duration data with meter readings of water passing into or out of the tank, variations in the performance of the heater, due to seasonal conditions or factors affecting efficiency, can be better accommodated than relying on temperature measurements of water in the tank.

By programming into the controller appropriate averaged load curve data from the power utility, the controller, by accessing the calendar, can match the required heating duration against a low in the load curve most appropriate to the day and season. As a preferred minimum, six different 24 hour load curves would be stored in the controllers memory namely weekdays and weekends for summer and winter and autumn/spring where the latter seasons can be treated as the same. A greater number of these data sets can be used to achieve finer tolerances in load leveling by the power utility. Usually the major low period in the power load curve is overnight, but there is sometimes a smaller low period during the day [9 am to 6 pm]. This second low can be utilized for emergency heating, where the amount of water passing through the meter, since the last heating period, indicates that there is likely to be insufficient water until the overnight heating cycle. The low in the load curve usually correlates with low power cost for the utility but not always. Ideally the load is adjusted to take advantage of lowest cost. One restraint is the need to maintain a relatively stable and smooth load curve to avoid sharp fluctuations in load.

The power controller and calendar clock need not be physically located on the tank but could be at another location such as the meter box, as long as they are electrically connected to the water tank and the water meter. The power controller and calendar clock can be incorporated into one device and sold separately for retrofitting to existing tanks.

An advantage of the system of this invention is that no daily communication between the power utility and the tank is needed. The program for each category can simply be updated when the electricity meter is read.

The water meter can be any simple measuring device that can provide a digital output equivalent to the volume of water either entering or leaving the tank. Where a pump is used to dispense water from the tank each cycle can be counted as a measure of water use from the tank.

Any electric water or solar/electric water heater can be used as long as it is adapted to have attached the timer/calendar, the controller and the water meter. The tank preferably has an inlet at the bottom and an outlet at the top of the tank with at least one heating element located adjacent the bottom of the tank. An external heater unit may be substituted for the internal heating element.

For the input of power to be most responsive to consumers hot water needs, it is desirable that an input of say 10% of the energy required heats 10% of the water to the desired temperature [eg >50° C.], rather than heating all the water and increasing the temperature by 10% of the difference between the cold water and the desired temperature. To do this the tank could have an element at the top of the tank, but it is preferred to use a tank with an element at the base of the tank and a canopy and flue over the element to guide the heated water to the top of the tank adjacent the hot water outlet. Heaters of this kind which produce a layer of hot water in the upper region of the tank have been described in patents such as U.S. Pat. No. 2,784,291, U.S. Pat. No. 4,587,401 and European 384423. By utilizing this structure and a more responsive heating control a smaller volume tank can be used thus saving capital costs.

Additional heating elements can be used if desired and these can be located in upper regions of the tank. However because of the superior control offered by the present invention when combined with a water tank that produces stratified layers of water, additional heating elements, for the purpose of emergency heating during peak periods, are not usually necessary.

The hot water tanks of this invention are preferably those which rely on stratification of the heated water so that the outlet is always drawing from the warmest strata in the tank. The tanks may be of any conventional material including plastics.

The advantage of using a plastic tank is that the problem of corrosion is eliminated. By eliminating corrosion the usable life of the tank is extended. If a plastic storage tank is used the tank can be a non pressure tank and be used in conjunction with a pump as disclosed in U.S. Pat. No. 4,437,484 or with a pressure transfer module as disclosed in WO 97/46805.

In another aspect of this invention there is provided a load leveling system for power utilities which includes a) a power utility b) a plurality of electric water heaters adapted to draw power from said power utility c) the water heaters are formed into at least two categories based on power rating or water heating times d) each water heater in a first category is also allocated into one of a number of groups e) and at least one control category of water heaters is composed of water heaters fitted with a water heater controller which is able to calculate the heating period required for the water heater and time the period of heating f) allocating each water heater in said control category into different groups so that the mid point of its heating period falls at approximately the mid point of the heating period for the group it has been allocated to g) and all the groups are arranged such that the heating of the tanks commences at different times for each group and the groups are sized and the start times are staggered so that the total power consumption by the water heaters occurs during periods of lowest cost to the utility This arrangement enables the power utility to spread the heating times for water heaters more evenly across the time span of the load low available for water heaters. Each group may be centered on a particular time and water heaters are allocated into the group on a statistical basis. Thus in the early evening one group could be centered on 9 pm and another on 11 pm. Because of the greater load available and probably the lower cost of power at 11 pm the number of tanks in the 11 pm category may be greater than those in the 9 pm group. The number of groups is variable and depends on how refined the smoothing of the load curve needs to be. With a larger number of groups the curve can be smoothed in smaller increments. Preferably the number of groups is from 20 to 80.

Alternatively instead of having different memberships in each group the numbers could be equivalent if the time spacing between the groups was closer during the lowest cost periods.

Another grouping system is to analyze existing customer usage and to calculate for each customer the average heating period required each day. Then by grouping the customers water tanks into groups based on required heating times the start times can be varied to spread the load.

The starting times for each group can be preset if the water heaters or premises are all fitted with time clock switches. A version with greater discrimination will include a calendar so that the controller would be programmed to start at different times depending on the day of the week and the season. Alternatively the power utility can use ripple control communication over the power line to switch heaters in each group on or off. More sophisticated communication systems could be used but this is unlikely to increase costs.

The categories are preferably based on average heating times or power consumption for the water heaters. This information may be gleaned from an analysis of the customers accounts or by using a metering system at the premises which stores the daily heating times. Preferably only two categories are formed, those with average to below average heating times and those with above average heating times. It is the category made up of water heaters with above average heating times that is fitted with controllers which can calculate and position the heating period more accurately. This enables the load curve to be smoothed and adjusted in a more refined way.

Preferably the water heater as defined above is utilized in this second aspect of the invention. It would not be necessary for all the water heaters drawing power from the utility to be fitted with the controller because with as few as 10% of heaters fitted with the controller a significant savings can be made by the power utility.

DETAILED DESCRIPTION OF THE INVENTION

A preferred embodiment of the invention will now be described with reference to the drawings in which.

Figure 1:
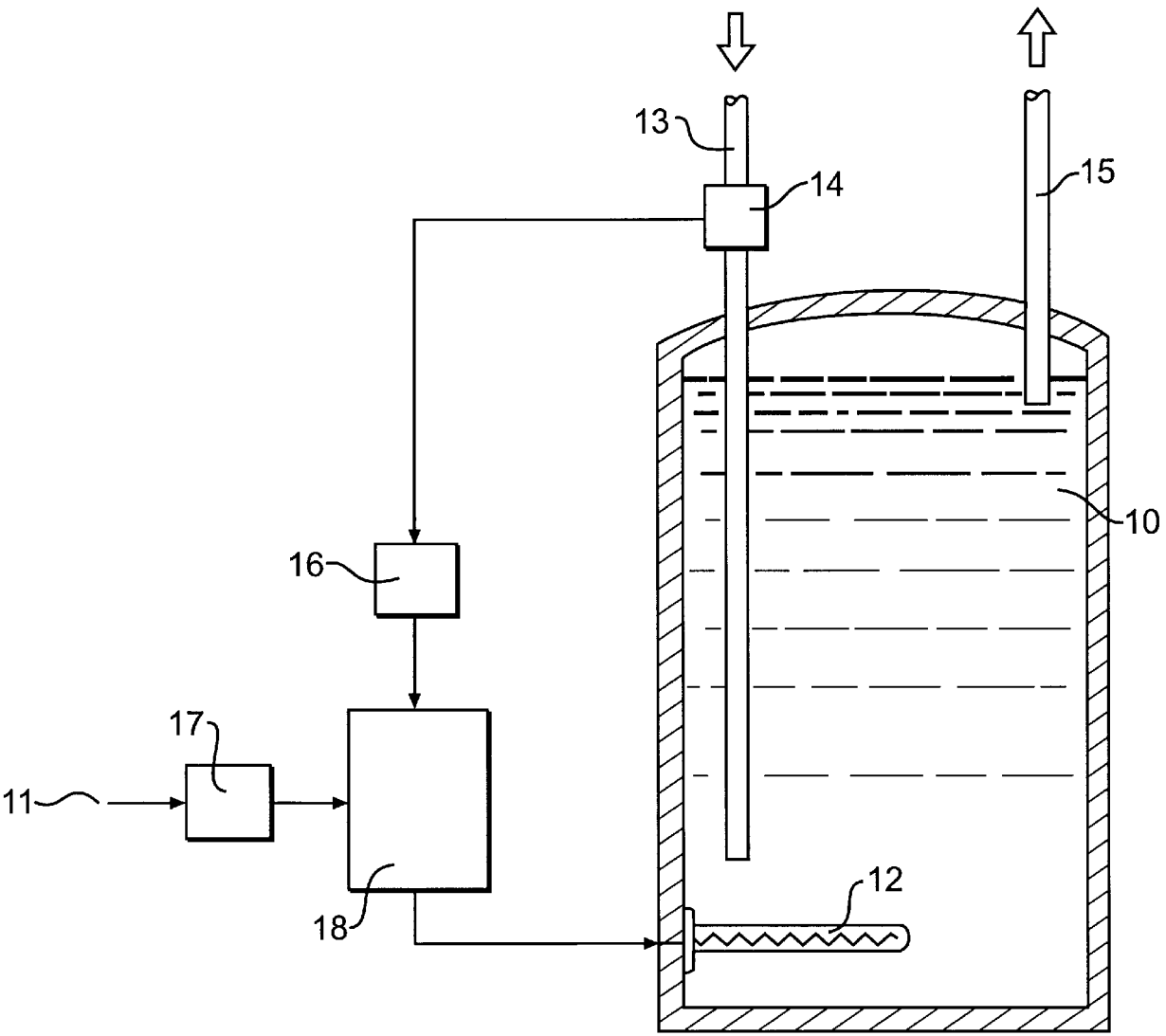
FIG. 1 is a schematic diagram of the present invention.

The water tank 10 may be any suitable tank having a suitable storage capacity. Preferably the tank is of moulded plastic and is unpressurized. The tank is preferably designed internally to produce temperature stratification of the water with the upper stratas being of higher temperature than the lower stratas. As mentioned previously, there are several prior patents which disclose arrangements that enable stratification to be achieved. In order to maintain the water in the tank in an unpressurized state and to deliver heated water at mains pressure a pressure transfer module as disclosed in WO97/46805 is preferred. The water inlet 13 introduces cold water into the base of the tank and the outlet 15 is located at the top where the warmer water strata will lie. The actual location of the inlet and outlet is not critical. In this embodiment the water flow meter 14 is located in the inlet pipe 13 and connected to the water flow counter 16. In an alternative embodiment the water flow meter 14 is a component of the pressure transfer module. By measuring the water entering the tank, heat stress on the meter is avoided. The heating element 12 is located adjacent the bottom of the tank. The power source 11 is connected to the heating element 12 via the time clock calendar 17 and the programmable memory device 18. Alternatively the timer and programmable device can be incorporated into the one microprocessor having a programmable RAM and a memory storage. The programmable device 18 is also connected to the water flow counter 16 to accumulate water usage data. The data is collected on a daily basis and as well as the current days data, data for the preceding 60 days is also held. A shorter or longer period could be used.

The calendar timer 17 is referenced by the programmable means 18 to identify the date and time and to collect element heating durations in similar fashion to the collection of water flow data. The means 18 is programmed to analyze the heating duration and water heater data by using for example, regression analysis of the historical data to calculate from the current days water flow count, the time required for drawing current in the next heating cycle.

Figure 3:
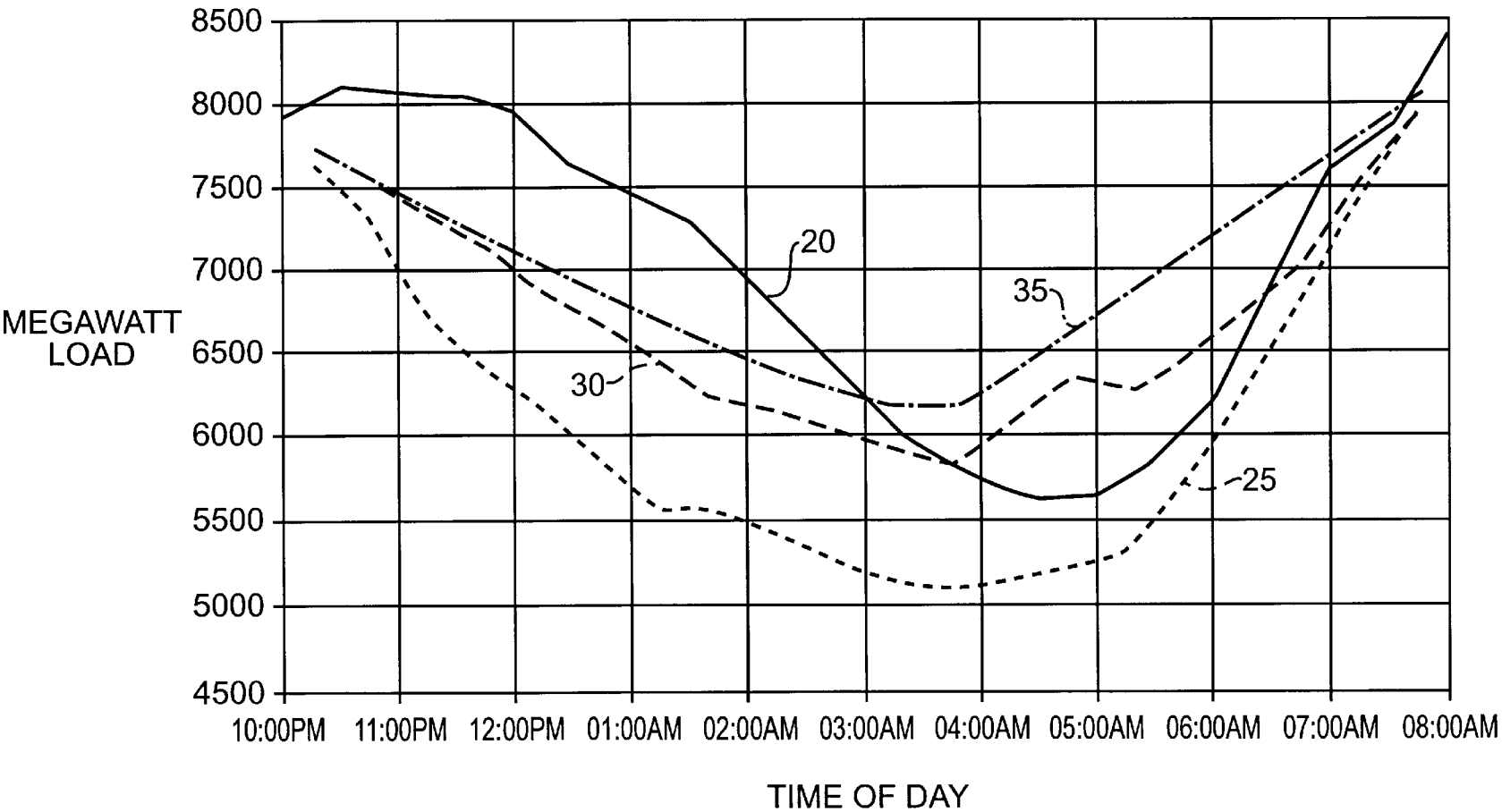
FIG. 3 is a graphical representation of a series of typical load curves for a power utility.

The programmable means 18 in its memory stores the load curve data of the type shown in FIG. 3. This will, as a minimum, contain 6 sets of curves for weekdays in summer winter and spring or autumn and sets for weekends in these three seasonal periods.

As is conventional in water heaters a thermostatically controlled off switch will terminate heating when the tank is fully heated to the desired temperature. On average the time allowed for heating the tank and the actual duration of heating will be the same.

FIG. 3 is an example of 4 power load curves. Curve 20 is an actual winter weekday load curve for a power utility. Curve 25 is the load curve 20 with the power used by accessible water heaters taken out. The major low in the absence of water heating occurs between 9 pm and 7 am.

Figure 2:
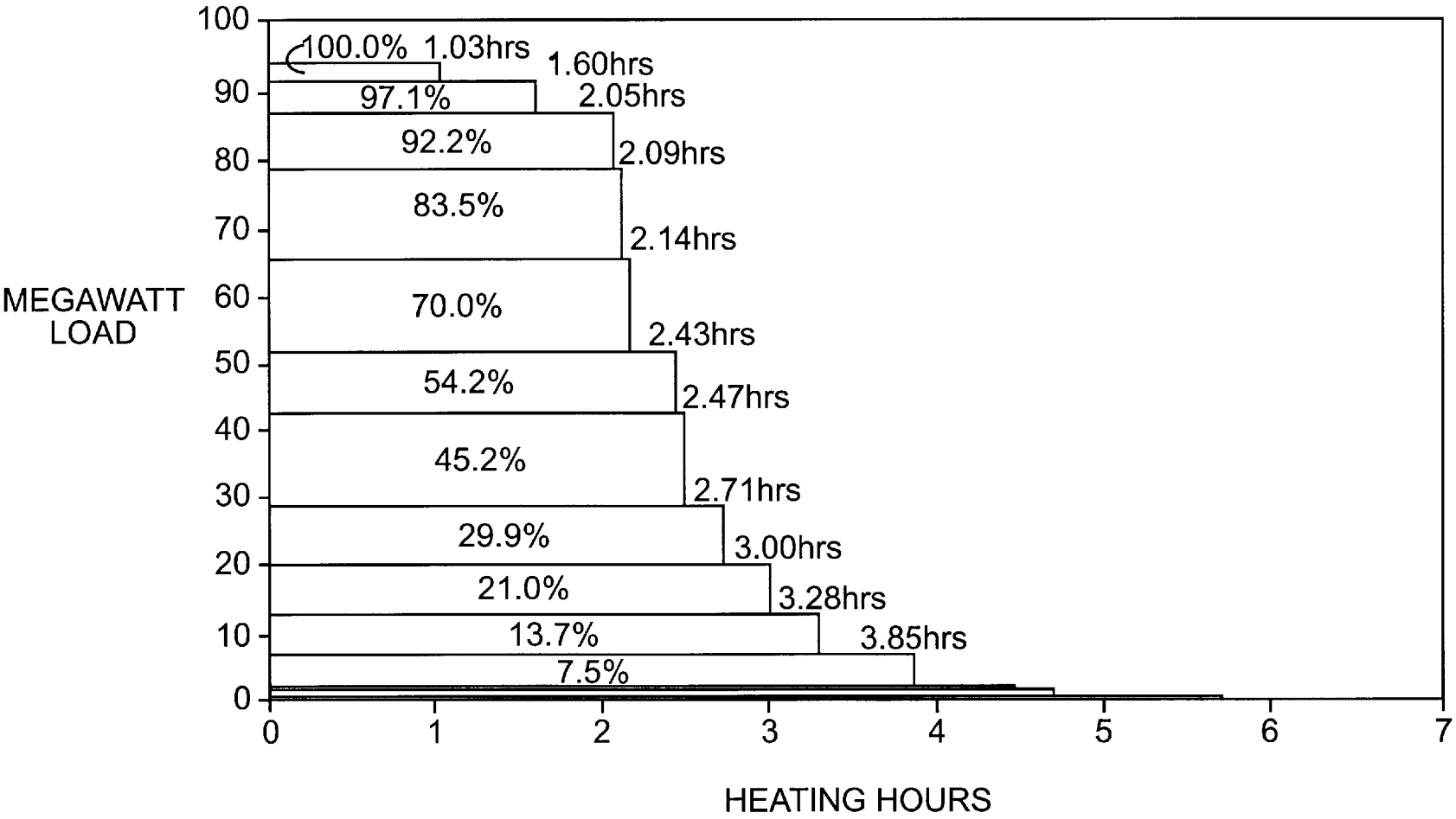
FIG. 2 is a breakdown of heating times for random group of water heaters serviced by a power utility.

FIG. 2 is an analysis of the average heating times for a statistically representative group of water heaters serviced by the power utility. It can be seen that the total power load is made up of groups requiring different average heating times. There are several small groups with quite long heating periods making up less than 10% of the total group. These are formed into a distinct category called category 1 and are best suited to a control system as described above. The remaining water heaters can form the other category, category 2.

When the power load for category 2 is allocated over the time span 10 pm to 8 am curve 30 is formed. When the power load for category 1 is also allocated curve 35 is the result. Compared to curve 20 curve 35 reduces power consumption between 10 pm and 3 am and increases it between 3 am and 7 am.

The required heating period calculated by device 18 is matched to a time period between 10 pm and 7 am to fill in the power load between curves 30 and 35. For example a two hour heating cycle could be completed in any two hour period between 10 pm and 7 am with the earliest heating beginning at 10 pm and the latest at 5 am.

Each controller is allocated into category 1 and placed into a predetermined group that selects the time for the mid point of the heating cycle. For example tanks in group 1 would all have the midpoints of their heating cycle at 1 am. Thus a tank in category 1 group 1 needing 4 hours of heating would be switched on at 11 pm and switched off at 3 am.

Tanks in category 2 would be placed into a series of groups preferably based on the heating requirements as shown in FIG. 2. One group with 2 hour heating times could be centred on 3 am and the heating times would extend from 2 am to 4 am.

In the example shown in FIGS. 2 and 3, 18 groups are used 8 in category 1 and 10 in category 2. In practice the number of categories and the number of groups can be varied according to need.

If the groups are evenly spaced in time then the numbers in the groups which are centered on times nearest the low point of the load curve will be correspondingly greater. Alternatively if the numbers are evenly distributed across the categories the time spacing of the group mid points can be closer together around the time of the low in the load curve.

The controller as described is independently capable of providing power load leveling without any instructions from the power distributor or power generator. However it is preferred that the controller incorporate a communications port capable of receiving data or instructions from the power distributor or power generator. The communications port can either accept data signals over a telephone line, wireless or radio signals, or ripple signals over the power lines. The signals may update the power load curve data stored in the programmable memory means 18, or modify the analysis programs in device 18. The signals may also be used as a means for the distributor or the generator to directly control the water heater by pausing or stopping the heating cycle or starting it at an earlier time if there are anomalies in the power usage on a particular day, e.g.

There was an emergency on the supply side

Wholesale supply pricing was exorbitant for a short period

Customer was in default on payment.

From the above it can be seen that the present invention provides a unique cost effective solution to controlling water heaters and providing power load leveling.

What is claimed is:

1. An electric water heater which includes:

a) a water tank;

b) an electric heating element disposed within said tank;

c) a cold water inlet into said tank;

d) a hot water outlet from said tank;

e) at least one thermostat in said tank or a water meter connected to said inlet or outlet to measure the amount of water used and/or a calendar/clock and timer connected to said element;

f) a memory store connected to at least one of said thermostat, water meter and calendar/clock and timer to record daily readings of i) the average temperature of the tank or the amount of water used in the period from one heating period to the next, or ii) the power used or the time required to heat the water in the tank to the desired temperature, and store the readings for a predetermined number of days;

g) a programmable means programmed to analyze the readings in the memory store and calculate for each day the time duration required to bring the water to the desired temperature;

h) said memory store including power load curve data collected from the power generator appropriate to the day of week and season; and i) said programmable means being programmed to match the required heating duration to a low cost portion of the load curve.

2. A water heater as claimed in claim 1 wherein:

a) the cold water inlet is in the base of the tank b) the hot water outlet is in the top of the tank and c) the tank is configured to allow temperature stratification of the stored water.

3. A water heater power controller which includes:

a) A connection to at least one thermostat located in the water storage tank and/or a connection to a water meter in the inlet or outlet of the water tank to measure the amount of water used b) a calendar/clock and timer connectable to the heating element of the water tank c) a memory store to record daily readings of i) the temperature change of the tank or the amount of water used in the period from one heating period to the next and/or ii) the power or the time duration required, to heat the water in the tank to the desired temperature and store the readings for a predetermined number of days d) a programmable means programmed to analyze the readings in the memory store and calculate for each day the time duration required to bring the water to the desired temperature e) said memory store including power load curve data collected from the power generator appropriate to the day of week and season and f) said programmable means being programmed to match the required heating duration to a low cost portion of said load curve.

4. A water heater power controller as claimed in claim 3 which calculates the duration of heating required and selects the start and finish times to fall within a period of low power cost.

5. A load leveling system for power utilities which includes:

a) a power utility b) a plurality of electric water heaters adapted to draw power from said power utility c) the water heaters are formed into at least two categories based on power rating or water heating times d) each water heater is also allocated into one of a number of groups such that the heating of the tanks commences at different times for each group and the groups are sized and the start times are staggered so that the total power consumption by the water heaters occurs during periods of lowest cost to the utility e) and at least one category of water heaters is composed of water heaters fitted with a water heater controller which is able to calculate the heating period required for the water heater and time the period of heating so that its mid point falls at approximately the mid point of the heating period for the group it has been allocated to.

6. A load levelling system as claimed in claim 5 in which said water heater controller includes:

a) a connection to at least one thermostat located in the water storage tank and/or a connection to a water meter in the inlet or outlet of the water tank to measure the amount of water used;

b) a calendar/clock and timer connectable to the heating element of the water tank;

c) a memory store to record daily readings of i) optionally the temperature change of the tank or the amount of water used in the period from one heating period to the next;

ii) the power or the time duration required, to heat the water in the tank to the desired temperature;

and store the readings for a predetermined number of days;

d) a programmable means programmed to analyze the readings in the memory store and calculate for each day the time duration required to bring the water to the desired temperature;

e) said memory store including power load curve data collected from the power generator appropriate to the day of the week and season; and f) said programmable means being programmed to match the required heating duration to a low cost portion of the load curve.

* * * * *